US010294791B2

(12) United States Patent
Chana et al.

(10) Patent No.: US 10,294,791 B2
(45) Date of Patent: May 21, 2019

(54) ROTARY ENGINE SEALS

(71) Applicant: OXFORD UNIVERSITY INNOVATION LIMITED, Botley (GB)

(72) Inventors: Kamaljit Singh Chana, Oxford (GB); Michael Joseph Pekris, Derby (GB)

(73) Assignee: OXFORD UNIVERSITY INNOVATION LIMITED, Botley, Oxford (GN)

( * ) Notice: Subject to any disclaimer, the term of this patent is extended or adjusted under 35 U.S.C. 154(b) by 45 days.

(21) Appl. No.: 15/121,323

(22) PCT Filed: Feb. 24, 2015

(86) PCT No.: PCT/GB2015/050522
§ 371 (c)(1),
(2) Date: Aug. 24, 2016

(87) PCT Pub. No.: WO2015/128628
PCT Pub. Date: Sep. 3, 2015

(65) Prior Publication Data

US 2017/0009582 A1 Jan. 12, 2017

(30) Foreign Application Priority Data

Feb. 25, 2014 (GB) ..... 1403285.8

(51) Int. Cl.
*F03C 2/00* (2006.01)
*F03C 4/00* (2006.01)
(Continued)

(52) U.S. Cl.
CPC ..... *F01C 19/06* (2013.01); *F01C 1/22* (2013.01); *F01C 19/005* (2013.01); *F01C 19/02* (2013.01);
(Continued)

(58) Field of Classification Search
CPC ..... F01C 19/005; F01C 19/02; F01C 19/04; F01C 19/08; F01C 19/06; F01C 19/10;
(Continued)

(56) References Cited

U.S. PATENT DOCUMENTS 3,081,745 A 3/1963 Hurley
3,263,913 A 8/1966 Fuhrmann et al.
(Continued)

FOREIGN PATENT DOCUMENTS

DE 10-2011-018346 A1 10/2012
DE 10-2011-086691 B3 11/2012
(Continued)

OTHER PUBLICATIONS

Warren, S., New Rotary Engine Designs by Deviation Function Method, eScholarship University of California, (2012).

*Primary Examiner* — Theresa Trieu
(74) *Attorney, Agent, or Firm* — Harness, Dickey & Pierce, P.L.C.

(57) ABSTRACT

A rotor assembly has a sealing system for sealing at apexes or faces of the rotor. An apex seal or face seal comprises a compliant member that is configured such that the shape or orientation of the compliant member can change in use in response to a change in the speed of rotation of the rotor, a change in the pressurization across the compliant member, or a change in clearance between the sealing surface and a mounting element to which the compliant member is mounted, to deflect towards or away from the sealing surface.

8 Claims, 6 Drawing Sheets

(51) Int. Cl.

| | |
|---|---|
| ***F04C 15/00*** | (2006.01) |
| ***F04C 2/00*** | (2006.01) |
| ***F01C 19/06*** | (2006.01) |
| ***F01C 1/22*** | (2006.01) |
| ***F01C 19/00*** | (2006.01) |
| ***F01C 19/02*** | (2006.01) |
| ***F01C 19/08*** | (2006.01) |
| ***F01C 21/08*** | (2006.01) |
| ***F01C 21/10*** | (2006.01) |

(52) U.S. Cl.
CPC ..... *F01C 19/08* (2013.01); *F01C 21/08* (2013.01); *F01C 21/10* (2013.01)

(58) Field of Classification Search
CPC .. F01C 1/22; F01C 21/08; F01C 21/10; F02B 53/005; F02B 2053/005
USPC ..... 418/61.2, 113, 123, 140, 124; 277/357, 277/370, 398, 403
See application file for complete search history.

(56) References Cited

U.S. PATENT DOCUMENTS

| | | | | |
|---|---|---|---|---|
| 3,758,243 | A | 9/1973 | Fox, Jr. | |
| 3,860,365 | A * | 1/1975 | Bibbens ..... | F01C 19/02 418/113 |
| 2013/0028769 | A1 | 1/2013 | Gekht et al. | |
| 2013/0028775 | A1 | 1/2013 | Gekht et al. | |

FOREIGN PATENT DOCUMENTS

| | | | |
|---|---|---|---|
| EP | 1420145 | A2 | 5/2004 |
| GB | 892476 | A | 3/1962 |
| GB | 1402675 | A | 8/1975 |
| GB | 1473561 | A | 5/1977 |

* cited by examiner

ROTARY ENGINE SEALS

CROSS REFERENCE TO RELATED APPLICATIONS

This application is a U.S. National Phase Application under 35 U.S.C. 371 of International Application No. PCT/GB2015/050522 filed on Feb. 24, 2015 and published as WO 2015/128628 A1 on Sep. 3, 2015. This application claims priority to British Application No. 1403285.8 filed on Feb. 25, 2014. The entire disclosures of all of the above applications are incorporated herein by reference.

FIELD

The invention relates to improved rotary engine seals.

BACKGROUND

Many different approaches are used for implementing the required apex and face seals in rotary engines. These include systems based on rigid blade elements which are mounted in grooves with retaining springs. Aluminium filled carbon and ceramic sealing elements are known. A common problem is that the seals are subjected to heavy wear and rapidly deteriorate, resulting in a loss of performance and fuel efficiency. While the parts themselves are relatively inexpensive, the process of dismantling an engine regularly to change worn seals is less so, and may not be possible in applications where the engine needs to be in continuous operation for prolonged periods of time. Carbon degrades at temperatures comparable to those in and in close proximity to the combustion region. The ceramic sealing solution provides a benefit in terms of low thermal coefficient of expansion and low friction coefficient, but is nevertheless prone to wear and breakage upon impact or due to a detonation.

It is an object of the invention to provide a seal which has a longer working life and/or improved performance.

SUMMARY

According to an aspect of the invention, there is provided a rotor assembly for a rotary engine, comprising: a housing; a rotor configured to rotate eccentrically within the housing; and a sealing system, wherein: the rotor comprises a plurality of apexes that are configured to engage with a radially inner sealing surface of the housing in order to define a plurality of separate working volumes, each working volume being located between two of the apexes, the radially inner sealing surface of the housing and a radially outer surface of the rotor; the sealing system comprises an apex seal located at one of the apexes, the apex seal being configured to provide an engagement between the apex and the radially inner sealing surface of the housing that inhibits movement of gas from one working volume to another working volume past the apex throughout the range of rotation of the rotor; the sealing system comprises a face seal located on a face of the rotor that is perpendicular to the axial direction, the face seal being configured to provide an engagement between the face of the rotor and a sealing surface of the housing that is perpendicular to the axial direction that inhibits movement of gas from one working volume to another past a portion of the face; the apex seal or the face seal comprises a compliant member, which is the part of the seal that most closely approaches the sealing surface; the compliant member is configured such that the shape or orientation of the compliant member can change in use in response to a change in the speed of rotation of the rotor, a change in the pressurisation across the compliant member, or a change in clearance between the sealing surface and a mounting element to which the compliant member is mounted, to deflect towards or away from the sealing surface.

Thus, a seal for a rotary engine is provided that is based on using one or more compliant members to engage with the sealing surface. Compliant members can engage with the sealing surface using lower contact forces and/or torques, or even substantially no contact forces or torques, in comparison with prior art seals based on non-compliant sealing members. This tends to reduce the rate at which the seals are degraded by wear during operation. Compliant seals can therefore last longer than non-compliant alternatives.

Compliant seals can also be provided in a wide variety of different forms, which provides flexibility for adapting the seals to achieve a range of desired functionalities. For examples, the seals can be selectively configured to achieve a desired balance between sealing performance and longevity, for example by modifying the materials, shapes and/or orientations or positions of the compliant members.

In an embodiment, the compliant members are provided in the form of a leaf seal, with a plurality of sheet-like compliant members, or a brush seal, with a plurality of bristle-like compliant members.

In an embodiment, the compliant members may be inclined relative to a normal to the sealing surface against which they engage so as to reduce a stiffness of the seal and/or improve sealing properties.

In an embodiment, air-riding devices are provided that apply a lifting force to the compliant members during operation. The lifting force may be such as to lift the compliant members clear of the sealing surface for a portion or all of the rotational range of the rotor. Applying such a lifting force reduces wear on the compliant member and increases longevity while maintaining low through-seal leakage.

According to a further aspect of the invention, there is provided a rotor assembly for a rotary engine, comprising: a housing; a rotor configured to rotate eccentrically within the housing; and a sealing system, wherein: the rotor comprises a plurality of apexes that are configured to engage with a radially inner sealing surface of the housing in order to define a plurality of separate working volumes, each working volume being located between two of the apexes, the radially inner sealing surface of the housing and a radially outer surface of the rotor; the sealing system comprises an apex seal located at one of the apexes, the apex seal being configured to provide an engagement between the apex and the radially inner sealing surface of the housing that inhibits movement of gas from one working volume to another working volume past the apex throughout the range of rotation of the rotor; the sealing system comprises a face seal located on a face of the rotor that is perpendicular to the axial direction, the face seal being configured to provide an engagement between the face of the rotor and a sealing surface of the housing that is perpendicular to the axial direction that inhibits movement of gas from one working volume to another past a portion of the face; the apex seal or the face seal comprises a sealing member, which is the part of the seal that most closely approaches the sealing surface; the sealing member is mounted on a resilient mounting member, the resilient mounting member being configured to allow displacement of the sealing member in a direction parallel to the normal of the portion of the sealing surface with which the sealing member engages; and the sealing system comprises an air-riding device which is shaped so as to apply a hydrostatic or hydrodynamic lift force to the sealing member during rotation of the rotor.

The air-riding device thus reduces or avoids contact between the sealing member and the sealing surface, thereby reducing wear of the seal and increasing longevity.

DRAWINGS

Embodiments of the invention will now be described, by way of example only, with reference to the accompanying drawings in which corresponding reference symbols indicate corresponding parts, and in which.

Figure 3:
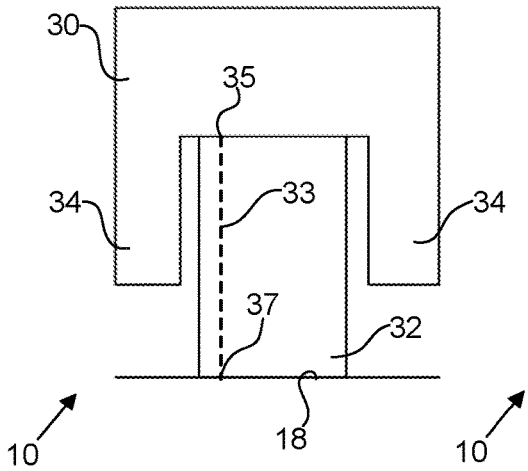
FIG. 3 is an axial view of an apex seal comprising a leaf seal.
Figure 4:
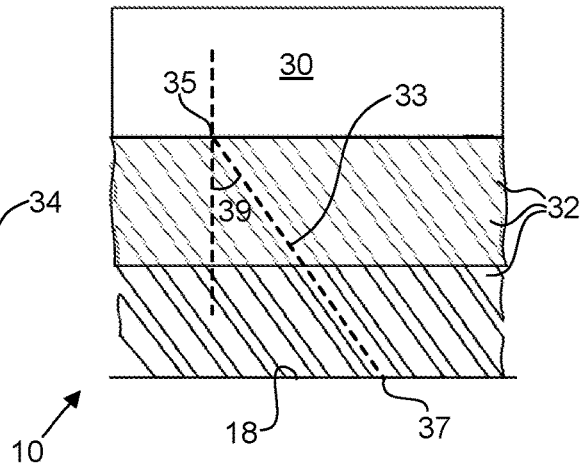
FIG. 4 is a view of the seal of FIG. 3 along a direction of relative movement between the seal and the sealing surface, illustrating the oblique angle made in this embodiment between the leaves of the seal and a normal to the sealing surface.
Figure 5:
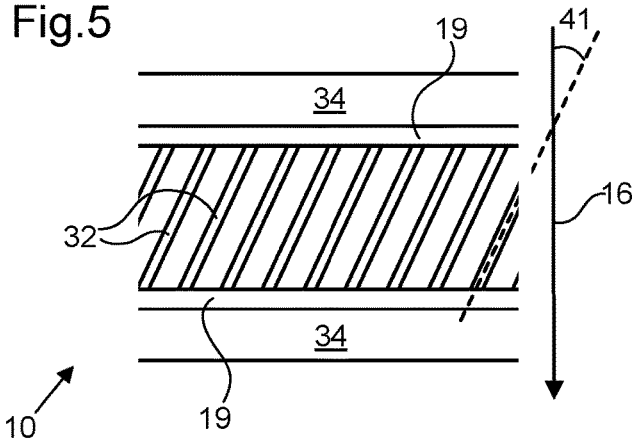
FIG. 5 is a radial view of the seal of FIGS. 3 and 4, illustrating the oblique angle made in this embodiment between the leaves of the seal and the direction of relative movement between the seal and the sealing surface.
Figure 6:
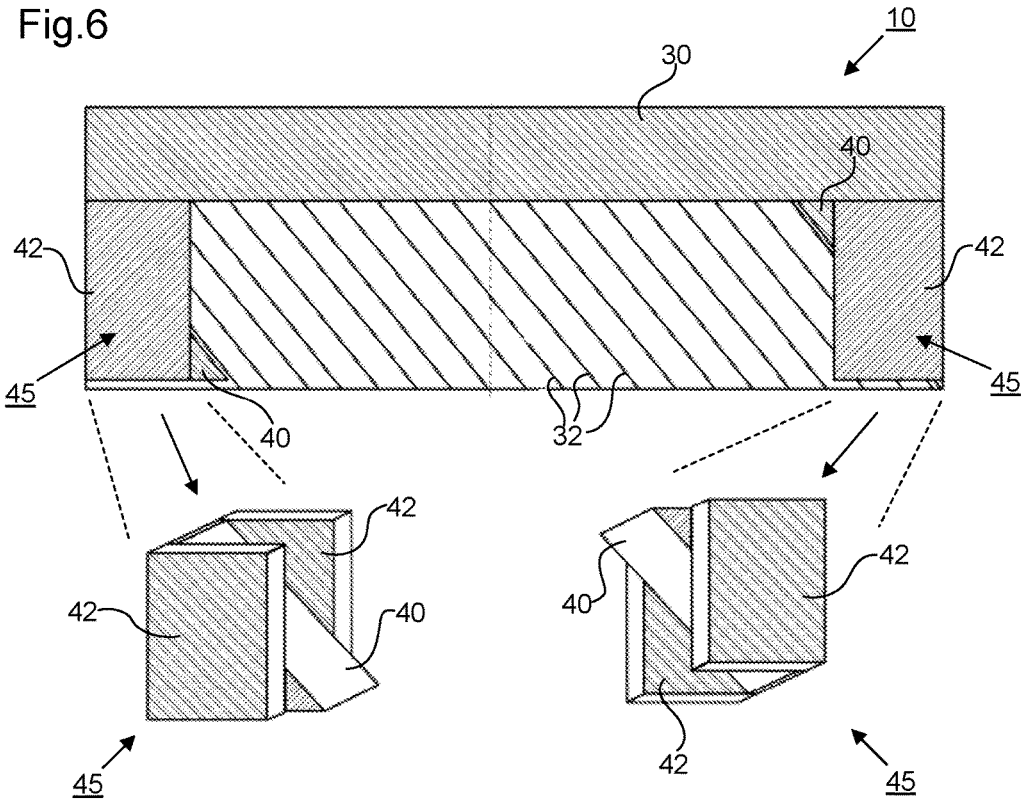
Figure 7:
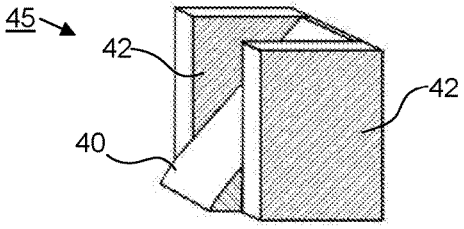
Figure 8:
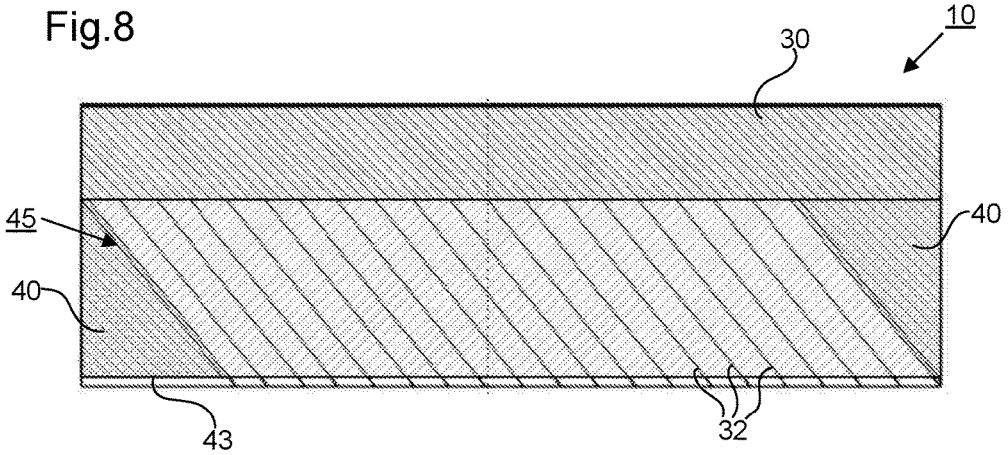
Figure 13:
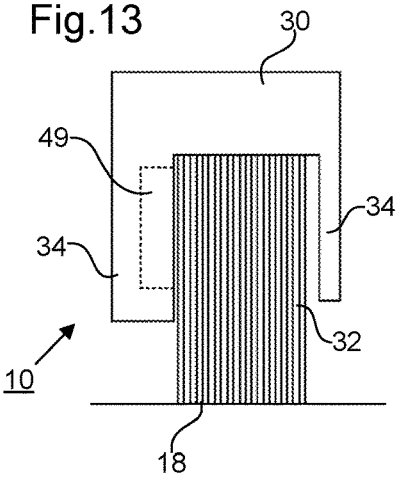
Figure 14:
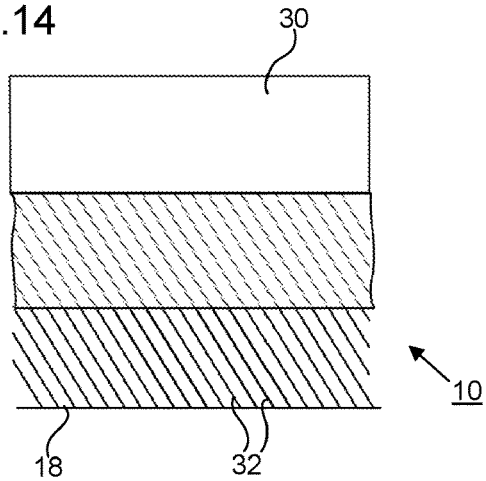
Figure 15:
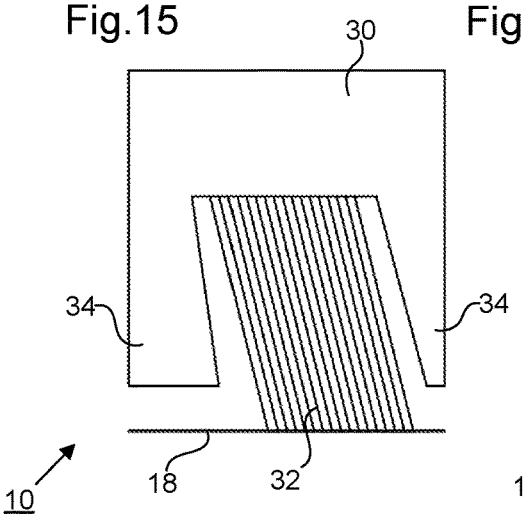
Figure 16:
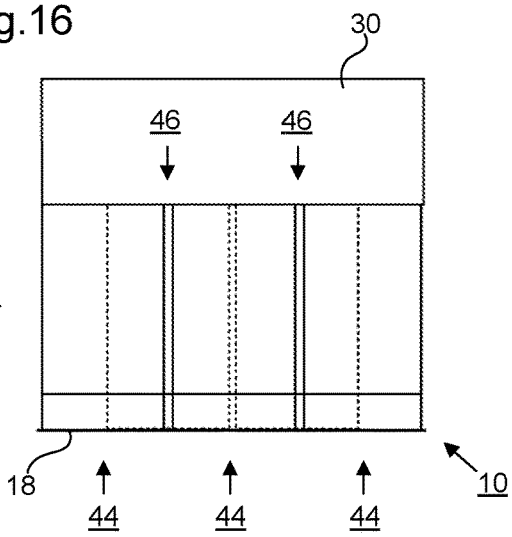
Figure 17:
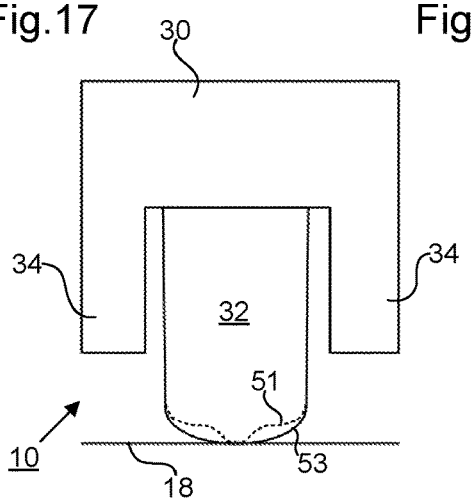
Figure 18:
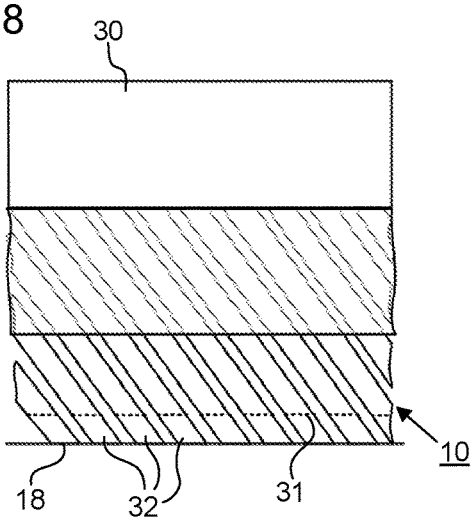
Figure 19:
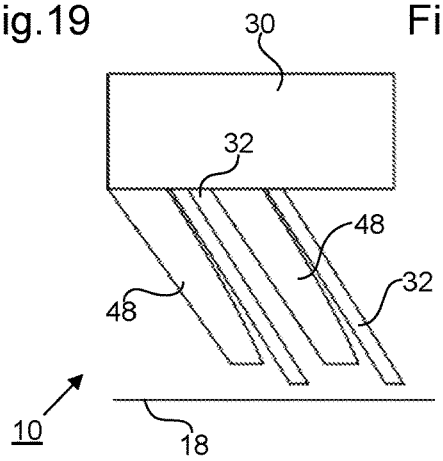
Figure 20:
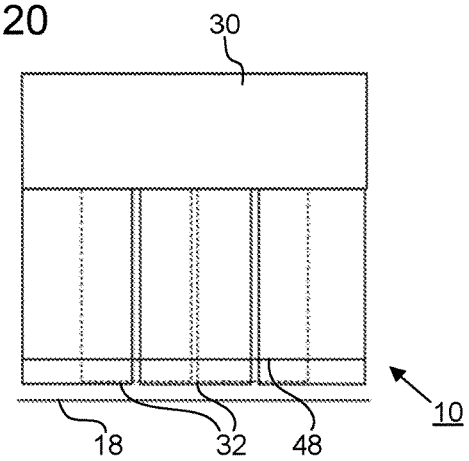
Figure 21:
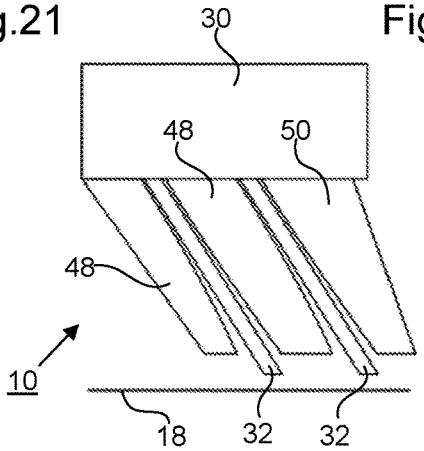
Figure 22:
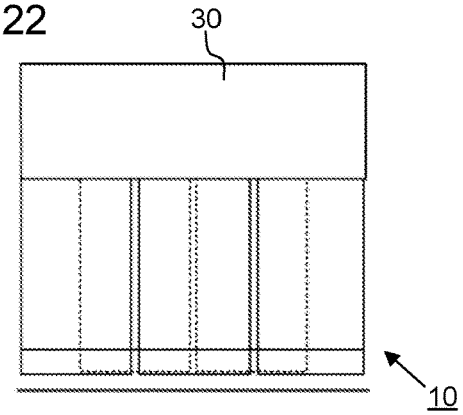
Figure 23:
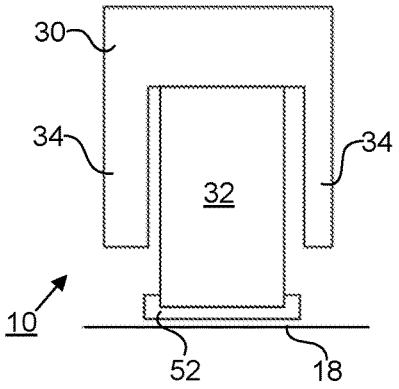
Figure 24:
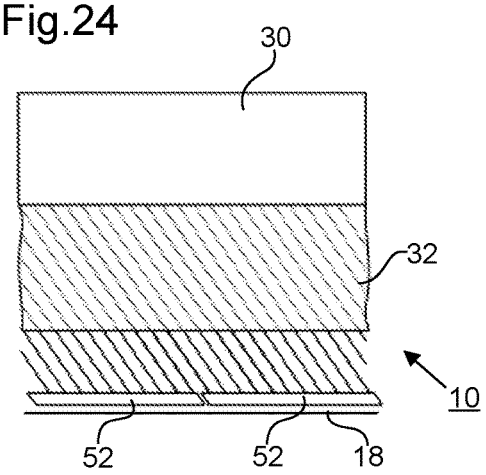
Figure 25:
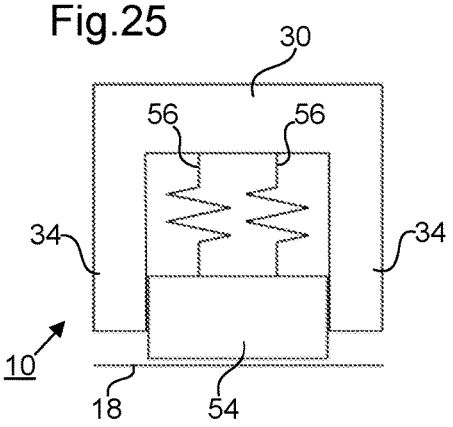
Figure 26:
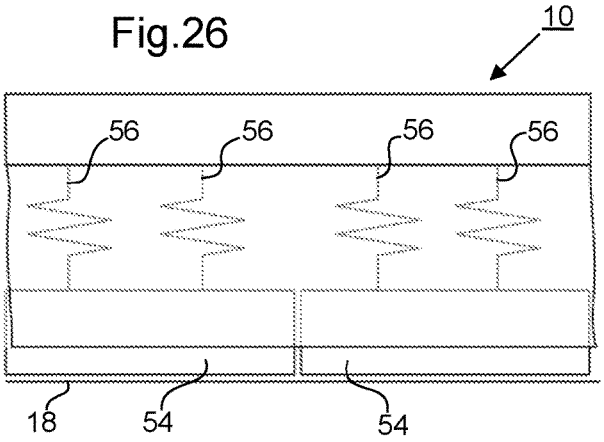
Figure 27:
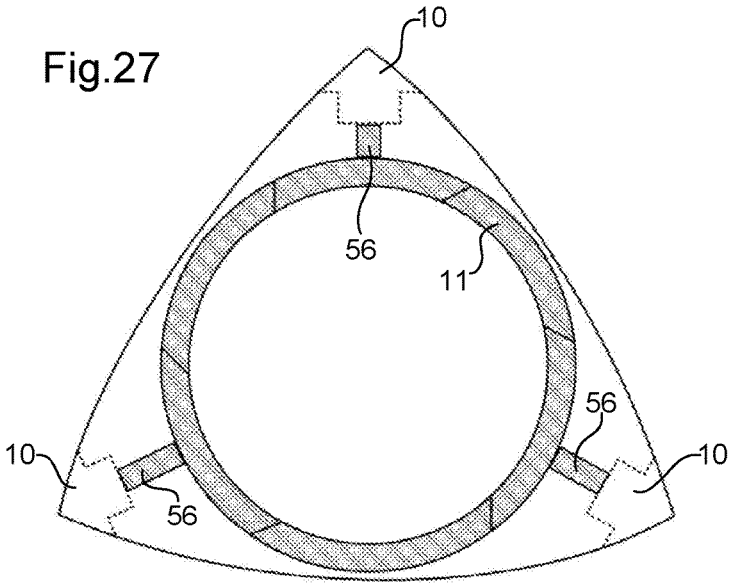

FIG. 6 depicts a seal of the type illustrated in FIGS. 3 to 5 except that the leaves are parallel to the direction of relative movement between the seal and sealing surface, the seal comprising also axial sealing members which provide sealing on the axial extremities of the seal between the seal and sealing faces of the housing that are perpendicular to the axial direction; the axial sealing members also provide some support to the inclined compliant members when deflecting onto the rotor (left) or away from the to rotor (right);

FIG. 7 depicts a variation of the axial sealing member that is profiled to apply a lift or support force to the leaves of the seal;

FIG. 8 depicts a variation of the embodiment of FIG. 6 in which an axial seal member is provided which has a lateral element extending along the full length of the seal between wedge members at axial extremities of the seal, thus acting as a flow-deflector;

FIGS. 9 to 12 depict different arrangements for providing sealing between the axial sealing member and a sealing surface of the housing that is perpendicular to the axial direction;

FIG. 13 is an axial view of an apex seal for an embodiment comprising a brush seal;

FIG. 14 is a view along the direction of relative movement between the seal and the sealing surface of the embodiment of FIG. 13, illustrating the oblique angle made between individual bristles of the brush and the normal to the sealing surface;

FIG. 15 is an axial view of an apex seal for an embodiment in which the seal comprises a plurality of leaves that are inclined relative to the normal to the sealing surface when viewed along the axial direction;

FIG. 16 is a view along the direction of relative movement between the seal and the sealing surface of the seal of FIG. 15, illustrating how, when viewed along the direction of relative movement, different leaves of the seal may overlap with each other;

FIG. 17 is an axial view of an apex seal in an embodiment in which the seal comprises a plurality of leaves and one or more of the leaves has a profiled tip;

FIG. 18 is a view along the direction of relative movement between the seal and the sealing surface of the seal of FIG. 17;

FIG. 19 is an axial view of an apex seal for an embodiment in which the seal comprises a plurality of compliant members and a plurality of non-compliant supporting elements;

FIG. 20 is a view along the direction of relative movement between the seal and the sealing surface of the seal of FIG. 19, illustrating how the compliant members and non-compliant supporting elements may overlap with each other;

FIG. 21 is an axial view of an apex seal for an embodiment in which the seal comprises a plurality of compliant members and a plurality of non-compliant supporting elements, in which non-compliant supporting elements are provided on both sides of the seal in order to provide support in the event of a transient reversal of the pressure differential across the seal;

FIG. 22 is a view along the direction of relative movement between the seal and the sealing surface of the seal of FIG. 21 illustrating how the sealing elements may overlap;

FIG. 23 is an axial view of an apex seal for an embodiment in which the seal comprises a plurality of leaves, a subset of which are connected together by a connecting element which is shaped so as to apply a lift force to the leaves that are connected to it under conditions of pressurization and/or rotor rotation;

FIG. 24 is a view along the direction of relative movement between the seal and the sealing surface of the seal of FIG. 23;

FIG. 25 is an axial view of an apex seal for an embodiment in which the seal comprises a sealing member mounted on a resilient member, where the sealing member(s) may be shaped to create a lift force when in close proximity to the housing surface, hence significantly reducing contact forces under conditions of pressurisation and/or rotor rotation;

FIG. 26 is a view along the direction of relative movement between the seal and the sealing surface of the seal of FIG. 25;

FIG. 27 is a view along the axial direction of a rotor in which the sealing system comprises apex and face seals that are connected to each other in order to inhibit movement of gas between different working volumes thorough a gap between any of the apex seals and the nearest face seal.

DETAILED DESCRIPTION

Figure 1:
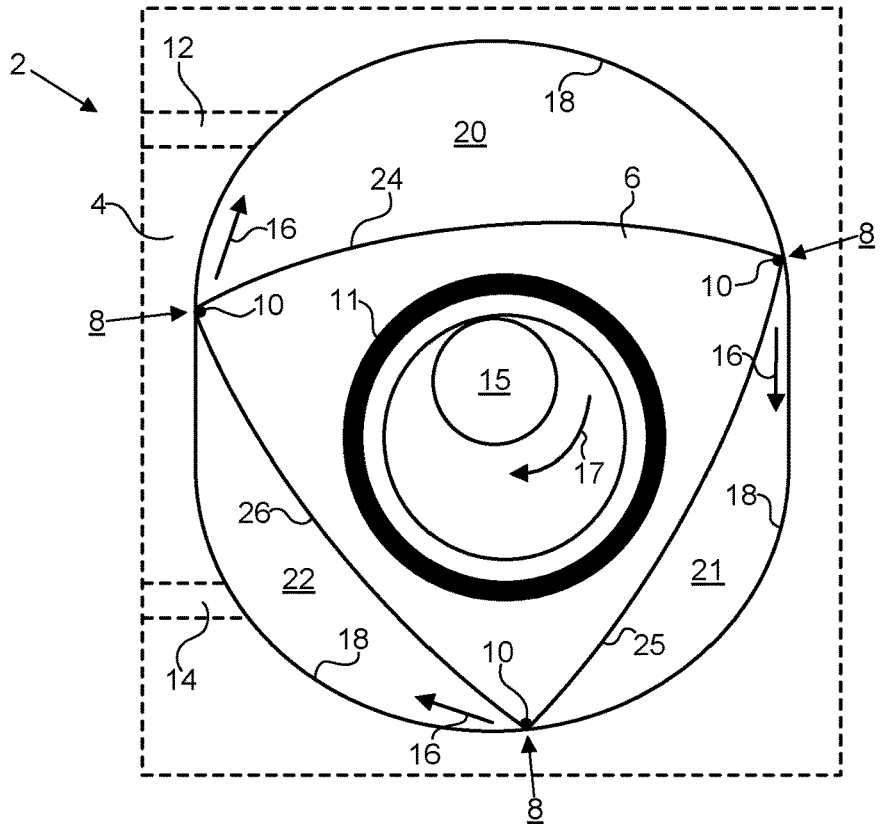
FIG. 1 is a schematic axial view of a rotor and a portion of a housing of a rotary engine to illustrate basic operation of the engine.

The present invention relates to a rotor assembly 2 for a rotary engine. The principle of operation of a rotary engine (examples of which are also known as Wankel engines) is well known to the skilled person. A schematic diagram of a portion of a rotary engine is shown in FIG. 1. A housing 4 is provided which defines a cavity within which a rotor 6 rotates eccentrically. The eccentric rotation transmits a torque to an output shaft (not shown) via a lobe 15 connected to the output shaft. The lobe 15 is eccentric relative to the axis of rotation of the shaft and moves in tight circles while driving the shaft. The rotation of the rotor 6 about the lobe 15 is indicated schematically by an arrow 17. The radially inner sealing surface 18 of the housing 4 is shaped so as to allow apex seals 10 located at apexes of the rotor 6 to remain engaged with the sealing surface 18 through the whole range of rotational movement of the rotor 6. In an embodiment, the shape of the radially inner sealing surface 18 is an epitrochoid.

The apex seals thus define three separate working volumes 20-22 which are separated from each other by the apex seals 10. Each working volume 20-22 is located between two of the apexes 8, the radially inner sealing surface 18 and a radially outer surface of the rotor 24-26. The working volumes 20-22 are also sealed in the axial direction by sealing surfaces of the housing 4 that are perpendicular to the axial direction.

Each of the apex seals 10 may be considered as part of a "sealing system" and each may be configured to provide an engagement (which may involve constant contact, intermittent contact, or no contact) between the seal 10 and the radially inner sealing surface 18. The engagement provides the sealing functionality, inhibiting or preventing movement of gas from one working volume 20-22 to another working volume 20-22 past the apex 8, throughout the range of rotation of the rotor 6.

In an embodiment, the sealing system also comprises a face seal 11 which is located on a face of the rotor 6 that is perpendicular to the axial direction. The face seal 11 is configured to provide an engagement between the face of the rotor 6 and a sealing surface of the housing that is perpendicular to the axial direction, the engagement again providing the sealing functionality, inhibiting or preventing movement of gas from one working volume 20-22 to another past a portion of the face of the rotor 6.

In an embodiment, the housing comprises intake and exhaust ports 12, 14 for supplying and extracting air and/or fuel to the working volumes 20-22 and spark plug ports (not shown) for accommodating spark plugs that combust the fuel in order to drive rotation of the rotor 6, in a manner that is analogous to the driving of pistons in a piston engine and is well known to the skilled person.

Figure 2:
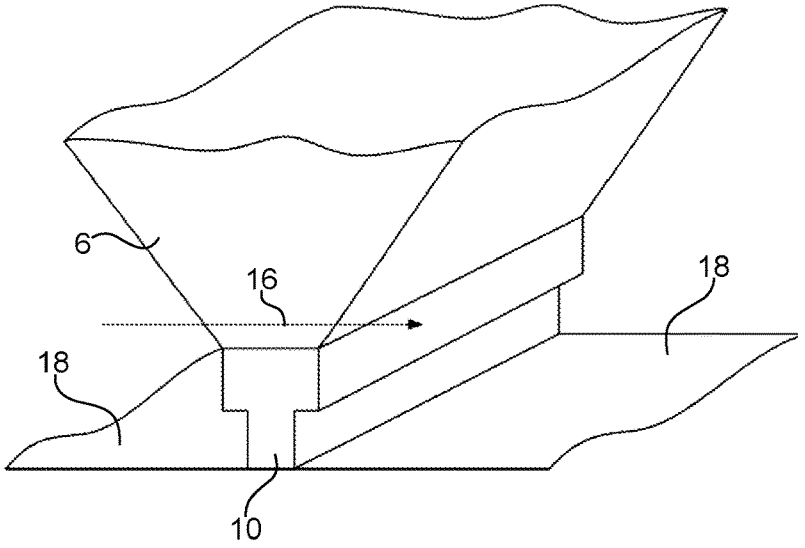
FIG. 2 is a schematic perspective view of an apex seal moving over the radially inner sealing surface of the housing.

The relative movement 16 between an apex seal 10 and the radially inner sealing surface 18 is illustrated in further detail in FIG. 2. The apex seal 10 extends along an axial direction between sealing surfaces (not shown) of the housing that are perpendicular to the axial direction.

In an embodiment, any or all of the apex seals and any or all of the face seals 11 each comprise one or more compliant members 32. The compliant members 32 are the parts of the seals 10,11 that most closely approach (or touch) the respective sealing surfaces. The compliant members 32 may take various forms. Examples are described below, with reference to FIGS. 3 to 24, in which the compliant member 32 is provided in the form of an element of a "brush" or a "leaf seal". In these embodiments, each seal comprises many of the compliant members (e.g. tens, hundreds or thousands of the compliant members). However, in other embodiments the seal may comprise fewer compliant members, or even just a single compliant member. The compliant member may also take forms that are different from a bristle of a brush or a leaf of a leaf seal.

A characteristic common to the compliant members 32 is that the shape or orientation of the compliant member 32 can change in use in response to a change in the speed of rotation of the rotor, a change in the pressurization across the compliant member, or a change in clearance between the sealing surface and a mounting element to which the compliant member is mounted, to deflect towards or away from the sealing surface. Preferably, the change in shape or orientation is reversible (e.g. elastic, with little or no plastic deformation or breakage occurring). Deflection away from the sealing surface may reduce wear on the compliant element while still allowing adequate sealing. Deflection towards the sealing surface may improve the extent to which the compliant member provides a seal throughout the full range of rotation of the rotor. Thus the shape or orientation of the compliant member can be substantially different during rotation of the rotor 6 (and therefore pressurisation of the seal) in normal use from the shape or orientation that would be adopted by the compliant member 32 if the rotor were stopped and removed from the housing at any time during normal use. In other words, the term "compliant" is intended to distinguish the compliant member over components of existing apex or face seals that are substantially rigid, such that the forces that are applied to such members during normal operation are insufficient to cause any substantial change in the shape or orientation of the element. Over a period of time such elements may change shape gradually due to wear, but such wear would not result in any significant change in shape between the (worn) shape of the member during rotation of the rotor and the shape that the member would have if the rotor were stopped and removed from the housing at any given time. Changes in shape associated with wear would also not be able to respond to changes in the speed of rotation of the rotor, changes in pressurisation across the compliant member or changes in clearance.

In an embodiment, the compliant member 32 is mounted to a mounting element 30 and extends through a region from the mounting element 30 to a position at which the compliant member 32 may engage with a portion of the sealing surface of the housing without being fixedly attached to any other component in the region. As mentioned above, the engagement may involve continuous contact between the compliant member 32 and the sealing surface. Alternatively, the compliant member 32 may be configured to lift away from the sealing surface during rotation. This may be achieved by providing the seal with an "air-riding" device. The air-riding device may be configured to induce hydrostatic or hydrodynamic lift forces on one or more of the compliant members 32 and/or elsewhere on the seal 10, 11. Sealing member tip geometries which encourage hydrodynamic lift enable one or more of the compliant members 32 to ride on a stiff film of air (which may be microns or tens of microns thick) during operation. Hydrodynamic lift features may similarly be applied to the casing surface where the swept path of the sealing members is known.

The term "engages" therefore encompasses contacting, intermittent, and non-contacting engagement.

FIGS. 3 to 5 illustrate an embodiment in which an apex seal 10 comprises a plurality of compliant members 32 formed as "leaves". In an embodiment of this type, each "leaf" may have a roughly planar or sheet-like form, with two dimensions that are much larger than a third dimension. Such a seal 10 may be referred to as a "leaf seal". FIG. 3 is a view of the apex seal along an axial direction. The gaps 19 between 34 and 32 are carefully set to control the pressure field in the seal and therefore the aerodynamic response of the compliant members. FIG. 4 is a view of a portion of the seal 10 along a direction parallel to the relative movement between the seal 10 and the sealing surface 18. FIG. 5 is a view from underneath the seal 10, looking radially outwards towards the sealing surface 18. Leaf seals offer a lower radial stiffness than seals which rely on one-dimensional, finger-like elements (e.g. a so-called "brush seal"—see below) due to reduced frictional forces, as well as increased axial rigidity. The leaves may have a variety of different forms. The leaves may have a variable cross-section. The cross-section may vary along the length of the compliant member, along the width of the compliant member, or both. The leaves may be complex shapes. The leaves may have a width that varies along the length of the compliant member. The leaves may be tapered or diverging along their lengths. The leaves may be nominally straight (i.e. planar) in their relaxed states or they may be curved in their relaxed states.

In this embodiment, the compliant members 32 are inclined relative to a normal to the portion of the sealing surface 18 with which they engage. Thus, a notional line 33 joining a point of contact 35 between the compliant member 32 and the mounting element 30 that is closest to a portion of the sealing surface 18 with which the compliant member 32 engages and the nearest point of contact 37 at which the compliant member 32 engages with the sealing surface 18 is aligned obliquely to the normal of the portion of the sealing surface 18 with which the compliant member 32 engages, for all angles of rotation of a rotor 6, during rotation of the rotor 6 in normal use, when the rotor 6 is stopped, or both. In the example of FIGS. 3 to 5, the oblique angle, when viewed along the direction of relative movement, is marked 39 in FIG. 4.

Arranging for the compliant members 32 to be at an oblique angle to the normal of the sealing surface 18 tends to reduce the stiffness of the compliant members 32 in respect to forces aligned along the normal to the sealing surface 18, which can beneficially reduce wear to the seal 10 and prolong the lifetime of the seal. The oblique angle may also improve the extent to which the seal can tolerate variations in the separation between the seal and the housing, which may occur for example due to unwanted movement of the rotor relative to the housing during operation. The oblique angle may also provide improved sealing under pressure.

The members 32 may vary in width or thickness profile along their length (in the direction along the notional line 35) such that, for example, the leaves may narrow in cross-section toward their tip that engages with the sealing surface 18, or may in other embodiments increase in thickness towards the tip.

As mentioned above, in the example of FIGS. 3 to 5, the compliant members 32 are arranged such that the notional line 33 makes an oblique angle 39 to the normal when viewed along the direction of relative movement between the seal and the sealing surface 18. The compliant members 32 may also be arranged so that they are aligned obliquely relative to the normal to the sealing surface when viewed in the axial direction. An example of such an embodiment is shown in FIGS. 15 and 16 described below.

In an embodiment, the compliant members 32 are configured such that, over a majority of the length of each compliant member 32 from the mounting element 30 to a position at which the compliant member 32 engages with the sealing surface 18, the compliant member 32 has a cross-section perpendicular to a normal of the sealing surface 18 that is elongate, for all angles of rotation of the rotor 6. The "leaves" of a leaf seal, as discussed above in the context of FIGS. 3 to 5, are examples of such compliant members. In such an embodiment, the direction of elongation of the cross-section may be aligned obliquely to the direction of relative movement between the seal 10 and the sealing surface 18. In the case where the direction of elongation varies along the radial length of the compliant member 32, it is preferable that a direction of elongation for a majority of the length of the compliant member 32 is at an oblique angle. Arranging for the compliant members 32 to be at such an oblique angle to the relative movement between the seal 10 and the sealing surface 18 tends to make any flow paths through the seal more tortuous, thereby tending to improve the sealing properties of the seal 10. In the example of FIG. 5, it can be seen that the portions of the compliant member 32 that are in contact with the sealing surface, which represent cross-sections of the compliant member 32 in the region of radial tips of those members 32, are aligned obliquely (at angle 41) relative to the direction of relative movement 16.

In an embodiment, the mounting element 30 may be provided with a lateral element 34 on one or both sides of the seal 10 (i.e. on opposite sides in the direction of relative movement between the seal 10 and the sealing surface 18). The lateral elements may be formed from a rigid material and a gap between the lateral elements 34 and the compliant members 32 may be provided which is such as to impart desirable forces onto the compliant members 32 during rotation of the rotor 6 in normal use. For example, the gaps between the lateral elements 34 and the compliant members 32 may be controlled to provide a required lift force to the compliant members 32 (which would tend to reduce wear of the compliant members 32) or a downward force (which would tend to improve the sealing properties of the compliant members 32).

In the case where the seal 10 comprises compliant members 32 which are at an oblique angle to the normal to the sealing surface when viewed along the direction of relative movement between the seal and the sealing surface, gaps (triangular in section) may exist between the axial extreme edges of the axially outermost compliant members 32 and the sealing surfaces of the housing which are perpendicular to the axial direction. In such a situation, axial sealing members 45 may be provided to ensure that an effective seal is made between the seal 10 and the sealing surfaces of the housing that are perpendicular to the axial direction. Examples of such axial sealing members 45 are shown in FIGS. 6 to 8.

FIG. 6 is a schematic view of an apex seal 10 viewed along the direction of relative movement between the seal 10 and the sealing surface 18. The seal 10 comprises one axial sealing member 45 at each of the two (left and right) axial extremities of the seal 10, which are shown in the lower insets in perspective form and slightly enlarged. In this embodiment, it can be seen that the axial sealing members 45 comprise a wedge member 40 which fills the gap between the compliant members 32 and the sealing surfaces, and lateral elements 42, which are located on the high and low pressure sides of the apex seal 10. The lateral elements 42 serve to mount the wedge portion 40 to the mounting element 30 and/or can be configured to divert flow in the region of the compliant members 32 in order to apply forces to the compliant members during use, as required. In an embodiment, the wedge element 40 can also be profiled (e.g. provided with a curved surface) in order to apply forces to the compliant members 32. An example of such an arrangement is shown in FIG. 7.

In the example of FIG. 6, the axial sealing members 45 are provided as separate elements connected together only via the mounting element 30. However, this is not essential. FIG. 8 illustrates an alternative arrangement in which the wedge elements 40 are connected directly together by single lateral elements 43 which extend across the entire axial length of the apex seal 10. As in the embodiment of FIG. 6, the shape and/or separation of the lateral element 43 of FIG. 8 and the compliant members 32 can be varied in order to apply desired forces to the compliant members 32 during rotation of the rotor 6 in normal use.

Various sealing features may be used to implement sealing between the axial sealing members 45 and the sealing surfaces of the housing that are perpendicular to the axial direction, with which the axial sealing members 45 engage. Examples are shown in FIGS. 9 to 12, which each show a radial view of one axial extremity of an apex seal. Relative movement between a portion of a sealing surface 70 with which the seal 10 engages and the seal 10 is vertical in the plane of the page.

Figure 9:
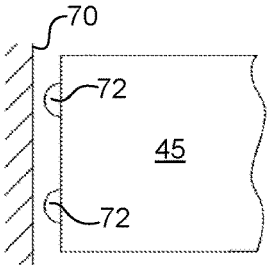
Figure 11:
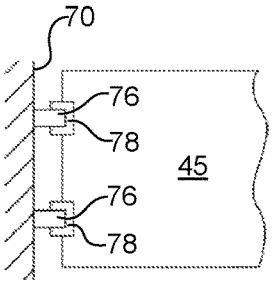
Figure 10:
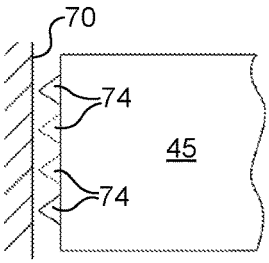
Figure 12:
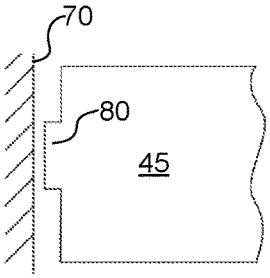

In the example of FIG. 9, a plurality of ribs 72 are provided that are parallel to a normal to the portion of the sealing surface 18 with which the seal 10 is engaged. In the example of FIG. 10, a labyrinth seal arrangement is provided, with protrusions 74 defining a labyrinthine flow path in the region between the axial seal member 45 and the sealing surface 70. The protrusions or portions of protrusions marked by broken lines are at a different depth than the protrusions or portions of protrusions that are marked by solid lines. The protrusions 74 may be elongate, in which case they may be referred to as "fins". The protrusions may be inclined or perpendicular to the sealing surface 70. In the example of FIG. 11, compliant members 76 are mounted to mounting members 78. These compliant members 76 may be configured in the same way as the compliant members 32 that are configured to provide sealing between the seal 10 and the sealing surface 18. In the example of FIG. 12, the material of the sealing member 45 is formed into a protrusion 80 for providing the sealing.

Alternatively or additionally, sealing features (which may or may not take the form of the example sealing features 72, 74, 76, 78 and 80 discussed above) are provided on the sealing surface 70. In an embodiment, an abradable or honeycomb lining is provided on the sealing surface 70, which may allow some cutting in the case where constant clearances cannot be maintained throughout the engine's operating cycle.

The examples described above relate to leaf seals, in which each of the compliant members 32 has a sheet-like form. However, this is not essential. Other forms of compliant member 32 may be used. For example, the compliant members 32 may be provided in the form of a brush, with each compliant member 32 of the brush having a finger-like form and having a length that is many times greater (e.g. ten times greater or more) than the width and depth of the cross-section (which may be approximately equal to each other). Each compliant member 32 in such an embodiment may be referred to as a "bristle". A brush seal bristle pack is particularly suited for use in rotary engines due to the effectiveness with which the bristles can respond to the 3-dimension nature of the relative movements between the seals and the sealing surfaces. The brush may contain tens, hundreds or thousands of such compliant members 32. The bristles in the bristle pack may be mounted in a hexagonal packing pattern and/or rows of bristles may be staggered relative to each other in order to increase flow blockage (sealing), for example. An example of an apex seal having bristles is shown schematically in FIGS. 13 and 14. FIG. 13 is a view along the axial direction and FIG. 14 is a view of a portion of the seal 10 along the direction of relative movement between the seal 10 and the sealing surface 18.

In the embodiment shown, the pressure differential across the seal 10 is expected primarily to be such that the right-hand side of the figure will be a high pressure side and the left-hand side will be a low pressure side. In an embodiment, the seal 10 comprises lateral elements 34 that are configured to provide support to the compliant members 32 on the low pressure side of the seal 10. In the example shown, this support is achieved by positioning a portion of the lateral element 34 on the low pressure side so as to be in contact with the nearest compliant member 32 (or at least in closer proximity to the nearest compliant member than the lateral element on the high pressure side of the seal 10). This support may be applied on both sides of the seal to provide tolerance to pressure reversals. In an embodiment, the lateral element 32 comprises an insert 49, which may comprise a solid material or may be hollow, to achieve the desired balance between support and stiffness.

In an embodiment the compliant members 32 are arranged so that a tip clearance between the compliant members 32 and the sealing surface 18 varies along the direction of the pressure gradient in such a way as to encourage hydrostatic lift of the compliant members 32 and reduced contact forces. In an embodiment, the tip clearance variation is applied on both sides (i.e. the nominally high pressure and nominally low pressure sides) so that the lift effect will be achieved even when there are reverse pressure differentials.

As mentioned above, the compliant members 32 may be configured so that they are at an oblique angle to the normal to the sealing surface 18 when viewed along the axial direction. FIGS. 15 and 16 illustrate an example of such a configuration, in a case where the compliant members 32 are leaves. However, it is also the case that other forms of compliant member 32, for example compliant members 32 formed in a brush as in FIGS. 13 and 14, may be arranged so as to be oblique to the normal to the sealing surface when viewed along the axial direction.

In an embodiment, the compliant members 32 that are aligned obliquely to the normal when viewed along the axial direction are inclined so that leading edges of the compliant members 32 (i.e. the edges nearest to the sealing surface 18) extend towards a high pressure side of the seal 10 (towards the right-hand side in the orientation of FIG. 15) relative to portions of the compliant members 32 that are nearer to the mounting elements 30 (further away from the sealing surface 18). In such an arrangement, the pressure gradient (which decreases from right to left in the orientation of FIG. 15) tends to force the compliant members 32 towards the sealing surface 18 and tends thereby to improve the sealing properties of the seal 10. Where it is envisaged that reverse pressure gradients may occur during operation, the seal 10 may be configured so as to have compliant members 32 that are aligned in both senses. For example, the seal 10 could comprise a first plurality of compliant members 32 which are aligned in the manner shown in FIG. 15 (or 19 or 21) and a second plurality of compliant members 32 which are aligned in the opposite sense (e.g. reflected in a mirror plane that is vertical and extending out of the page in the orientation of FIG. 15, 19 or 21). In this way, one of the two pluralities of compliant members will always be forced by the pressure gradient to make a stronger seal regardless of whether the pressure gradient is oriented from right to left or left to right.

In an embodiment the seal 10 comprises a plurality of the compliant members 32 and at least two of the compliant members 32 overlap, at least partially, when viewed in a direction parallel to the direction of relative movement between the seal 10 and the sealing surface 18. FIG. 16 shows an example of such an arrangement. Here, a portion of the seal 10 is shown which comprises three compliant members 44 in a first row and two compliant members 46 in a second row, behind the first row. The compliant members 44 in the first row are offset relative to the compliant members 46 in the second row by about half the width of a compliant member 44, thereby leading to overlap between the compliant members 44,46. Arranging for the compliant members to overlap makes the flow path for gas through the seal 10 more tortuous and tends to improve the sealing properties of the seal 10.

In an embodiment, an edge of the compliant member 32 that is closest to the portion of the sealing surface 18 with which the compliant member 32 engages is profiled (i.e. shaped) so that a hydrodynamic or hydrostatic lift force is applied to the compliant members 32 during rotation of the rotor 6 in normal use, thereby significantly reducing contact torques and wear. FIGS. 17 and 18 show an example embodiment of this type. FIG. 17 is a view of the seal along the axial direction and FIG. 18 is a view parallel to the direction of relative movement between the seal 10 and the sealing surface 18. Two example shapes for the profiled edges 51 (suggesting a generic shape) and 53 of the compliant members 32 are shown. The compliant member 32 may be profiled on both the high pressure and low pressure sides (as shown) or on one or the other of the sides only. In FIG. 18, the broken line 31 illustrates where the profiling of the edges begins (i.e. the portion of the edge below the broken line 31 is profiled while the rest is not profiled).

Profiling the compliant members 32 in the manner described above (e.g. by rounding) also tends to reduce material stresses in the compliant members 32, which may be particularly beneficial for the more rigid geometries of compliant members (such as the leaves in leaf seals).

In the case where a plurality of compliant members 32 are stacked in the direction of the pressure gradient across the seal (e.g. as in the embodiment of FIG. 15), the lengths of at least a subset of the compliant members 32 may be made to vary (linearly or non-linearly) from the high pressure side to the low pressure side in order to achieve a corresponding variation in a clearance between the tips of the compliant members 32 and the sealing surface 18, thereby achieving similar effects to the profiling discussed above with reference to FIG. 17. Varying the lengths in this way causes at least some of the compliant members to have different separations from the portion of the sealing surface of the housing with which the compliant members engage. Other variations in the properties of the compliant members may also be used. For example, two or more of the compliant members in the face or apex seals may have different thicknesses, shapes or lengths relative to each other, for example.

In the embodiments discussed above, individual compliant members 32 are either in contact with each other or separated from each other only by other compliant members 32 or by air. However, this is not essential. In other embodiments, non-compliant supporting elements may be provided in between two or more of the compliant members 32. FIGS. 19 to 22 illustrate example configurations of this type. FIG. 19 depicts a seal 10 viewed along the axial direction in which compliant members 32 are supported by non-compliant supporting elements 48 each positioned on a nominally low pressure side of one of the compliant members 32. Thus, each of the non-compliant supporting elements 48 provides support which prevents excessive deformation of a compliant member 32 in the direction of decreasing pressure. FIG. 20 is a view of a portion of the seal 10 parallel to the direction of relative movement between the seal 10 and the sealing surface 18. The close proximity of the supporting elements 48 also improves damping.

FIGS. 21 and 22 are views that correspond to those of 19 and 20 except that in the embodiment shown an additional non-compliant supporting element 50 is provided on a nominally high pressure side of the first compliant member 32. This configuration thus provides support for the first compliant member 32 in the event that there is a transient reversal of the pressure gradient during operation. This embodiment is an example of an embodiment in which a non-compliant supporting element 48 is provided on both sides of the plurality of compliant members in the direction of relative movement between the portion of the sealing surface of the housing with which the compliant members engage and the compliant members. The non-compliant supporting elements 50 can be rigid (i.e. such that they substantially retain their shape during use). Alternatively, supporting elements can be provided that are positioned in the same way as the non-compliant supporting elements 50 but are configured so that they can deflect or deform to a significant extent during use (preferably less than the deflection or deformation of the compliant members). For example, such supporting elements can be configured to deflect in the direction of the pressure-gradient so as to match any intended or unintended deflection of the plurality of compliant members.

In various of the embodiments discussed above, features may be provided to the compliant members 32 or to elements such as the lateral elements 34 or axial sealing members 45 that cause a lift force to be applied to the compliant members 32 when the rotor 6 is rotated in normal use. Such lift forces may be generated for example by hydrodynamic or hydrostatic forces arising due to the pressure gradients and flows established across the seals 10. Any elements which apply a lift force to the compliant members 32 (i.e. a force that is directed away from the sealing surface 18), which may for example be attached to the seal members 32 in FIGS. 19-21, can be referred to as "air-riding" devices. The air-riding devices may apply a lift force which is such as to cause the compliant member 32 to be lifted clear of the sealing surface 18 for a majority or all of the range of rotation of the rotor 6. Lifting the compliant member 32 clear of the sealing surface 18 reduces the wear on the compliant member 32 and improves longevity. The separation between the compliant member 32 and the sealing surface 18 can be arranged to be sufficiently small that the compliant member 32 still effectively seals the working volumes 20-22 from each other.

In all of the embodiments discussed above, each of the compliant members 32 is free to move relative to all of the others, at least through a limited range of positions. In the embodiments discussed, there is no rigid connection between adjacent compliant members 32 except where those members are attached to the mounting element 30. However, this is not essential. In other embodiments, two or more of the compliant members 32 may be connected to each other at positions other than directly adjacent to or within the mounting element 30. For example, a subset or all of the compliant members 32 in a given seal 10 may be connected to each other at a position which is separated from the position at which those compliant members 32 are connected to the mounting element 30, for example in the region of the tips of the compliant members 32 (directly adjacent to the sealing surface 18). Connecting the compliant members 32 together in this way may be used to adjust the dynamic properties of the plurality of compliant members 32, for example in order to adjust the damping or stiffness of the compliant members 32. Such adjustment may be desirable to achieve a good balance between longevity and sealing properties, for example, and/or to avoid resonance during use. Alternatively or additionally, the or groups of the compliant members 32 may be connected together in such a way as to provide a hydrodynamic or hydrostatic lift force to the compliant members 32. An example of such an embodiment is illustrated in FIGS. 23 and 24.

FIG. 23 is a view of a seal along the axial direction and FIG. 24 is a view of the seal 10 along a direction parallel to the relative movement between the seal 10 and the sealing surface 18. In this embodiment, a connecting element 52 is provided which connects together a subset of the compliant members 32. In this embodiment, the connecting element 52 is shaped so as to apply a lift force to the compliant members 32 during rotation of the rotor 6 in normal use. The connecting element 52 is thus an example of an "air-riding" device. These may comprise steps or tapers along the direction of the expected pressure drop (or on both sides so as to cope with a pressure-reversal) which encourage hydrostatic lift.

In the embodiment shown in FIGS. 23 and 24, the connecting elements 52 are provided at the extreme tips of the compliant members 32. However, this is not essential. In other embodiments, a connecting element 52 is provided at an intermediate position between the tips of the compliant members 32 and the mounting elements 30.

In the embodiments discussed above, the compliant members 32 are connected rigidly to the mounting elements 30. The compliant properties of the compliant members 32 are provided by deformation of the complaint members 32 that occurs within the compliant members 32 themselves. The compliance of the compliant members 32 thus contributes to the reduced stiffness of the seal. However, it is not necessary that the compliance of the compliant members 32 contribute all of the reduced stiffness. In an embodiment, the compliant members 32 may be mounted themselves on a resilient mounting member that also contributes to the reduced stiffness of the seal. An example of such an embodiment is shown in FIGS. 25 and 26.

FIG. 25 is a view of the seal 10 in the axial direction and FIG. 26 is a view of the seal 10 along the direction of relative movement between the seal 10 and the sealing surface 18. In this embodiment, a sealing member 54 is provided that engages with the sealing surface 18 to provide the seal. The sealing member 54 is connected to the mounting element 30 via a resilient mounting member 56. The resilient mounting member 56 is configured to allow displacement of the sealing member 54 in a direction parallel to the normal of the portion of the sealing surface 18 with which the sealing member 54 engages. The resilient mounting member 56 is also configured to apply a restoring force to the sealing member 54 that is directed towards the sealing surface 18. In an embodiment, the resilient mounting member 56 comprises one or a plurality of springs or equivalent means of providing the desired stiffness. For example, the spring may be formed using a standard (metallic or other) coil spring, a wave spring or other supporting structure or compressible organic or inorganic material which can achieve the required stiffness properties over the operating conditions.

In an embodiment, the sealing member 54 is a compliant member, for example according to one or more of the embodiments discussed above. Alternatively, the sealing member 54 is not compliant.

In an embodiment, the sealing member 54 comprises an air-riding device, for example one or more hydrostatic or hydrodynamic (pressure-raising) features that enable the seal to ride on a stiff film of air (which may for example be microns or tens of microns thick) during operation. This delivers a significant reduction in leakage and frictional heat generation and wear, and hence extended component life. Air-riding operation may begin soon after rotation (for example within the first few hundred rpm). The sealing member 54 may be manufactured from a carbon, ceramic or metallic material.

In an embodiment related to FIGS. 25 and 26, the interface between the fore and aft members 34 and sealing element 54 may comprise a spring to resist the axial pressure loading across the seal in order to avoid seizure of 54 in its housing and to ensure that radial compliance of 54 is maintained. Alternatively or in combination to this, pressure communication channels may be incorporated into 34 to ensure pressure-balancing across some or the majority of member 54. At this interface, on the upstream or downstream side, or both, a secondary seal may be placed to prevent secondary flows compromising the function of the seal. A low-friction coating may be applied at these interfaces to ensure that friction is minimised between contacting parts including but not limited to the secondary seal. The secondary seal may be polymeric, metallic, ceramic or other material type and may be designed to effect a better seal when a pressure is applied. The secondary seal may be spring loaded or supported by a spring in order to be able to deflect under high transient loads between 54 and 34. Further, the surfaces of 34 and 54 at this interface may be curved, stepped or profiled to reduce frictional contact area or to exploit hydrostatic force components that can offset the axial pressure load.

In a further embodiment in relation to FIGS. 25 and 26, members 34 may form diaphragms or other spring like elements that are able to resist the pressure load. These may also provide the radial flexibility demanded of elements 56, or may simply be a means of preventing a secondary leak path while helping to avoid frictional locking.

The sealing member 54 may comprise a single element across the full axial width, or may be segmented along the width, for example to give improved tolerance of thermo-mechanical distortions or excessive local pressure transients. The interfaces between such segments may be staggered with one or more tapers or steps or similar as a means of creating a tortuous leakage path. The element or elements may be supported with multiple springs as may be required to give redundancy and the necessary flexibility. The sealing member 54 may comprise an internal secondary seal (between different segments of the sealing member 54). The internal secondary seal may comprise a notch or a separate seal type which could be required to prevent the leakage flow circumventing the main sealing section of each segment. The sealing surface of the sealing member 54 (i.e. the surface facing the sealing surface 18 of the housing) may be stepped, tapered or profiled in the direction of relative movement between the seal 10 and the sealing surface 18 in order to provide a hydrodynamic or hydrostatic lift force to assist non-contact operation. Other hydrodynamic features may include but are not limited to steps (protruding or inset) or grooves (linear, tapered, helical, chevron, star) of varying geometry. Such features may be applied to both the leading and trailing edge of the sealing member 54 so that the lift force may be both rotation-driven and differential pressure-driven in case these effects act on opposite sides of the sealing member 54. These features may similarly be applied to the axial-end-faces of the sealing member 54 in order to minimise side-leakages. In an embodiment, one or more of the sealing features such as those discussed above in relation to FIGS. 9-12 may be provided to prevent side-leakages, for example.

The embodiments described above have been described in the context of apex seals only. However, it is to be understood that any of the seals described can be applied also to the face seals. In this case, it is to be understood that all references to sealing surface above (in the context of apex seals) would be understood to mean the sealing surfaces of the housing that are perpendicular to the axial direction (instead of the radially inner and outer sealing surfaces which are applicable when considering apex seals).

In order to prevent gas from moving between different working volumes through a gap between any of the apex seals 10 and the nearest face seal 11, either or both of the apex seals 10 or face seals 11 may be configured to conform with each other so that no such gap exists. In an embodiment, separate conformance seals 56 may be provided to ensure this connection is made. An example of such a configuration is illustrated in FIG. 27. The dotted lines indicate the regions where the apex seals are attached, and which may be used to create a conforming seal at the apex regions due to the close proximity between them.

Segmentation of the apex or face seals may be employed to improve operation and in some cases simplify build. In an embodiment, the face seals 11 comprise individual arcuate sections which provide effective sealing of the three cavities as schematically illustrated in FIG. 27 (however, this is not essential; in other embodiments, the face seals may comprise, or may be arranged as, a continuous, for example circular, ring).

In an embodiment, the seals 10,11 are configured with a cold-build gap or interference between the seal tips and the sealing surface of the housing in order to compensate for relative thermo-mechanical growths during operation. In addition, in linear sections of such seals 10,11, it may be beneficial to employ multiple sealing elements of varying profile (width or thickness) along their length to assist with element dynamic stability under higher differential pressures. This may be achieved with steps, tapers or another optimised profiles.

In an embodiment, the apex seals 10 are glued in place, retained in slide-in slots, and/or attached using screw holes which are also used to attach other components of the rotor assembly. The seals may be inset further into the rotor than prior art configurations to provide the necessary space for the seals.

In an embodiment, the face seals 11 are glued, screwed, inserted directly into slots or holes with a tapered (no-return) notch mechanism, and/or inserted in a recess and rotated to engage with slots or castellations so that they may be held rigidly in position. If segmented this may simplify the installation, and centrifugal forces during operation may also be exploited to ensure rigid seal retention.

In the case of the face seals, the seals may be machined into the rotor face (without supporting springs) and by allowing a very small degree of movement of the rotor (or housing) along its axis, the gaps on either side between the housing and rotor may therefore be allowed to equalise. It would be necessary to ensure that the hydrostatic and hydrodynamic components of lift force (and therefore air film stiffness) dominate the axial displacement to make this robust, and to ensure that the system would be inherently stable.

The seals 10,11 may contact the sealing surface (e.g. continuously, or transiently, for example during start-up or shut-down or other duty-cycle related transients) and therefore must be designed to tolerate this contact. Hard wearing coatings such as Chromium Carbide Nichrome, Chrome Nitride or similar may be applied to the seal or sealing surface. Coatings or tribopairs which are known to provide a much-reduced interfacial friction coefficient, may be employed to help ensure seal performance retention.

The natural frequency of any compliant component (e.g. compliant member 32), as determined by its geometry, may be tuned so as to avoid resonance and failure during operation.

In any of the embodiments discussed above, the compliant members may be formed from the same material or from different materials. Each compliant member may be formed from a single material or may be formed from a plurality of different materials connected together, for example in the form of a laminate. In an embodiment, one or more of the compliant members are formed from two or more materials that have different coefficients of thermal expansion, arranged in such a way that under high thermal loads the one or more compliant members will be caused to flex, optionally away from the portion of the sealing surface with which they were engaged. Such compliant members may comprise a first material forming a main body of the compliant member and a second material attached thereto over a portion or all of the length of the compliant member.

Where reference is made in the above to "during rotation of the rotor" or "during normal use" or the like, it is to be understood that this should encompass typical operating conditions (e.g. temperatures, pressures and rates of rotation) of commercially available rotary engines.

A plurality of instances of one or more of the above-described sealing arrangements may be provided at the same apex or face seal, in a series or multi-stage arrangement. Each series of sealing arrangements may comprise two or more of the same type of seal or two or more different types of seal. In an embodiment, a plurality of cover plates are provided upstream or downstream (or both) of the compliant members in one or more of the series of sealing arrangements. The cover plates may be radially aligned to not radially aligned. The cover plates may be configured to act as labyrinth seals, whose outer radius is in clearance but close proximity to the inner sealing surface 18 of the housing. This arrangement would assist with the pressure holding capability of the sealing system, thus reducing the load on the portion of the seal comprising the one or more compliant members. When applied to apex seals, the rotor shape may be extended in the region of the apex to provide more circumferential space for the additional stages of the sealing system, in a "hammer-head fashion".

The invention claimed is:

1. A rotor assembly for a rotary engine, comprising:

a housing;

a rotor configured to rotate eccentrically within the housing; and a sealing system, wherein:

the rotor comprises a plurality of apexes that are configured to engage with a radially inner sealing surface of the housing in order to define a plurality of separate working volumes, each working volume being located between two of the apexes, the radially inner sealing surface of the housing and a radially outer surface of the rotor;

the sealing system comprises an apex seal located at one of the apexes, the apex seal being configured to provide an engagement between the apex and the radially inner sealing surface of the housing that inhibits movement of gas from one working volume to another working volume past the apex throughout the range of rotation of the rotor;

the sealing system comprises a face seal located on a face of the rotor that is perpendicular to the axial direction, the face seal being configured to provide an engagement between the face of the rotor and a sealing surface of the housing that is perpendicular to the axial direction that inhibits movement of gas from one working volume to another past a portion of the face;

the apex seal or the face seal comprises a compliant member, which is the part of the seal that most closely approaches the sealing surface;

the compliant member is configured such that the shape or orientation of the compliant member changes in use in response to a change in the speed of rotation of the rotor, a change in the pressurisation across the compliant member, or a change in clearance between the sealing surface and a mounting element to which the compliant member is mounted, to deflect towards or away from the sealing surface, wherein the compliant member is mounted to the mounting element and extends through a region from the mounting element to a position at which the compliant member engages with a portion of the sealing surface of the housing without being fixedly attached to any other component in said region, wherein a notional line joining a point of contact between the compliant member and the mounting element that is closest to a portion of the sealing surface of the housing with which the compliant member engages and the nearest point of contact at which the compliant member engages with the sealing surface is aligned obliquely to the normal of the portion of the sealing surface of the housing with which the compliant member engages, for all angles of rotation of the rotor, during rotation of the rotor, when the rotor is stopped, or both, wherein the notional line is at an oblique angle to said normal when viewed along a direction of relative movement between the compliant member and the portion of the sealing surface with which the compliant member is engaged, for all angles of rotation of the rotor, during rotation of the rotor, when the rotor is stopped, or both.

2. The rotor according to claim 1, wherein the compliant member is configured such that change in shape or orientation of the compliant member is reversible.

3. The rotor assembly according to claim 1, wherein the apex seal comprises a plurality of the compliant members and further comprises an axial sealing member located at an axial extremity of the apex seal and shaped so as substantially to fill a gap between an axially extreme one of the compliant members and an axially facing sealing surface of the housing.

4. The rotor assembly according to claim 1, wherein the apex seal comprises a plurality of the compliant members and further comprises an axial sealing member located at an axial extremity of the apex and shaped so as to divert flow during rotation of the rotor in order to apply a lift force to the compliant members.

5. The rotor assembly according to claim 1, wherein, over a majority of the length of the compliant member from the mounting element to a position at which the compliant member engages with the sealing surface of the housing, the compliant member has a cross-section perpendicular to a normal of the portion of the sealing surface of the housing with which the compliant member engages that is elongate, for all angles of rotation of the rotor.

6. The rotor assembly according to claim 5, wherein, over a majority of the length of the compliant member from the mounting element to a position at which the compliant member engages with the sealing surface of the housing, a direction of elongation of the cross-section perpendicular to the normal of the portion of the sealing surface of the housing with which the compliant member engages is aligned obliquely to the direction of relative movement between the compliant member and the portion of the sealing surface of the housing with which the compliant member engages.

7. The rotor assembly according to claim 1, wherein the apex or face seal comprises a plurality of the compliant members.

8. The rotor assembly according to claim 1, wherein one or more of the compliant members are formed from two or more materials that have different coefficients of thermal expansion, arranged in such a way that under high thermal loads the one or more compliant members will be caused to flex away from the portion of the sealing surface with which the compliant members are configured to engage.

* * * * *